US009188933B2

(12) United States Patent
Tada et al.

(10) Patent No.: US 9,188,933 B2
(45) Date of Patent: Nov. 17, 2015

(54) POWER SUPPLY DEVICE AND IMAGE FORMING APPARATUS

(71) Applicants: Kaoru Tada, Osaka (JP); Kozo Yamazaki, Hyogo (JP); Tatsuo Fukushima, Osaka (JP); Yuuki Shiga, Hyogo (JP); Haruo Hashimoto, Osaka (JP)

(72) Inventors: Kaoru Tada, Osaka (JP); Kozo Yamazaki, Hyogo (JP); Tatsuo Fukushima, Osaka (JP); Yuuki Shiga, Hyogo (JP); Haruo Hashimoto, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 116 days.

(21) Appl. No.: 14/065,550

(22) Filed: Oct. 29, 2013

(65) Prior Publication Data

US 2014/0133881 A1 May 15, 2014

(30) Foreign Application Priority Data

Nov. 12, 2012 (JP) ..... 2012-248389
Feb. 15, 2013 (JP) ..... 2013-027462

(51) Int. Cl.
*G03G 15/00* (2006.01)

(52) U.S. Cl.
CPC ..... *G03G 15/80* (2013.01)

(58) Field of Classification Search
CPC ..... G03G 15/80
USPC ..... 399/90; 439/700, 824
See application file for complete search history.

(56) References Cited

U.S. PATENT DOCUMENTS

| | | | | |
|---|---|---|---|---|
| 6,029,019 | A * | 2/2000 | Kawai | 399/90 |
| 2004/0005165 | A1* | 1/2004 | Yoon et al. | 399/90 |
| 2004/0228646 | A1* | 11/2004 | Sekiguchi et al. | |
| 2005/0008393 | A1 | 1/2005 | Kuma et al. | |
| 2011/0268467 | A1* | 11/2011 | Ishii et al. | 399/90 |
| 2013/0064568 | A1* | 3/2013 | Fujiwara et al. | 399/90 |

FOREIGN PATENT DOCUMENTS

| | | |
|---|---|---|
| JP | 2005-037652 | 2/2005 |
| JP | 2005-049553 | 2/2005 |
| JP | 2008-242070 | 10/2008 |
| JP | 2009-244313 | 10/2009 |
| JP | 2010-049100 | 3/2010 |
| JP | 2010-286636 | 12/2010 |
| JP | 2011-059348 | 3/2011 |

* cited by examiner

*Primary Examiner* — Susan Lee
(74) *Attorney, Agent, or Firm* — Harness, Dickey & Pierce, P.L.C.

(57) ABSTRACT

A power supply device to electroconductively connect a power-fed terminal included in a power-fed unit and a power supply terminal of a power supply board. The power supply device includes a unit contact portion to contact the power-fed terminal; a board contact portion to contact the power supply board; a connector to connect the unit contact portion and the board contact portion; and a support member to support the unit contact portion, the board contact portion, and the connector. The unit contact portion is held on an inner face of the support member opposed to the power-fed unit; the board contact portion is held on an outer face of the support member opposed to the power supply board; and the connector connects the unit contact portion and the board contact portion through the support member.

18 Claims, 16 Drawing Sheets

POWER SUPPLY DEVICE AND IMAGE FORMING APPARATUS

CROSS-REFERENCE TO RELATED APPLICATION

The present application claims priority pursuant to 35 U.S.C. §119 from Japanese patent application numbers 2012-248389 and 2013-027462, filed on Nov. 12, 2012, and Feb. 15, 2013, respectively, the entire disclosures of which are incorporated by reference herein.

BACKGROUND

1. Technical Field

The present invention relates to a power supply device conductively connecting a power-fed unit to a power supply board, the power-fed unit, and an image forming apparatus.

2. Related Art

In a copier, a printer, a facsimile apparatus, or a multifunctional apparatus including the capabilities of the above devices, a power supply board in an image forming apparatus supplies electricity to various electric/electronic parts and components, such as a developing device and a transfer device.

Japanese Patent No. 4360141 (JP-2005-037652-A) discloses a structure to conductively connect a power supply board to a charging roller via a contact portion and necessary wiring including a first frame disposed at the power supply board and a second frame disposed at the charging roller. In particular, the power-fed contact portion is implemented as a terminal with a bar-shaped protrusion and a coil spring to press the terminal toward the charge roller side to facilitate positional alignment of the power-fed side contact portion.

However, the above patent literature discloses wiring between the power feeding-side contact portion and the power-fed side contact portion that is installed between the first frame and the second frame so as to be sandwiched therebetween, thereby complicating assembly.

SUMMARY

Accordingly, the present invention provides a power supply device to electroconductively connect a power-fed terminal included in a power-fed unit and a power supply terminal of a power supply board. The power supply device includes a unit contact portion to contact the power-fed terminal; a board contact portion to contact the power supply board; a connector to electrically connect the unit contact portion and the board contact portion; and a support member to support the unit contact portion, the board contact portion, and the connector. In the power supply device, the unit contact portion is held on an inner face of the support member opposed to the power-fed unit; the board contact portion is held on an outer face of the support member opposed to the power supply board; and the connector connects the unit contact portion and the board contact portion through the support member.

These and other objects, features, and advantages of the present invention will become apparent upon consideration of the following description of the preferred embodiments of the present invention when taken in conjunction with the accompanying drawings.

DETAILED DESCRIPTION

Figure 1:
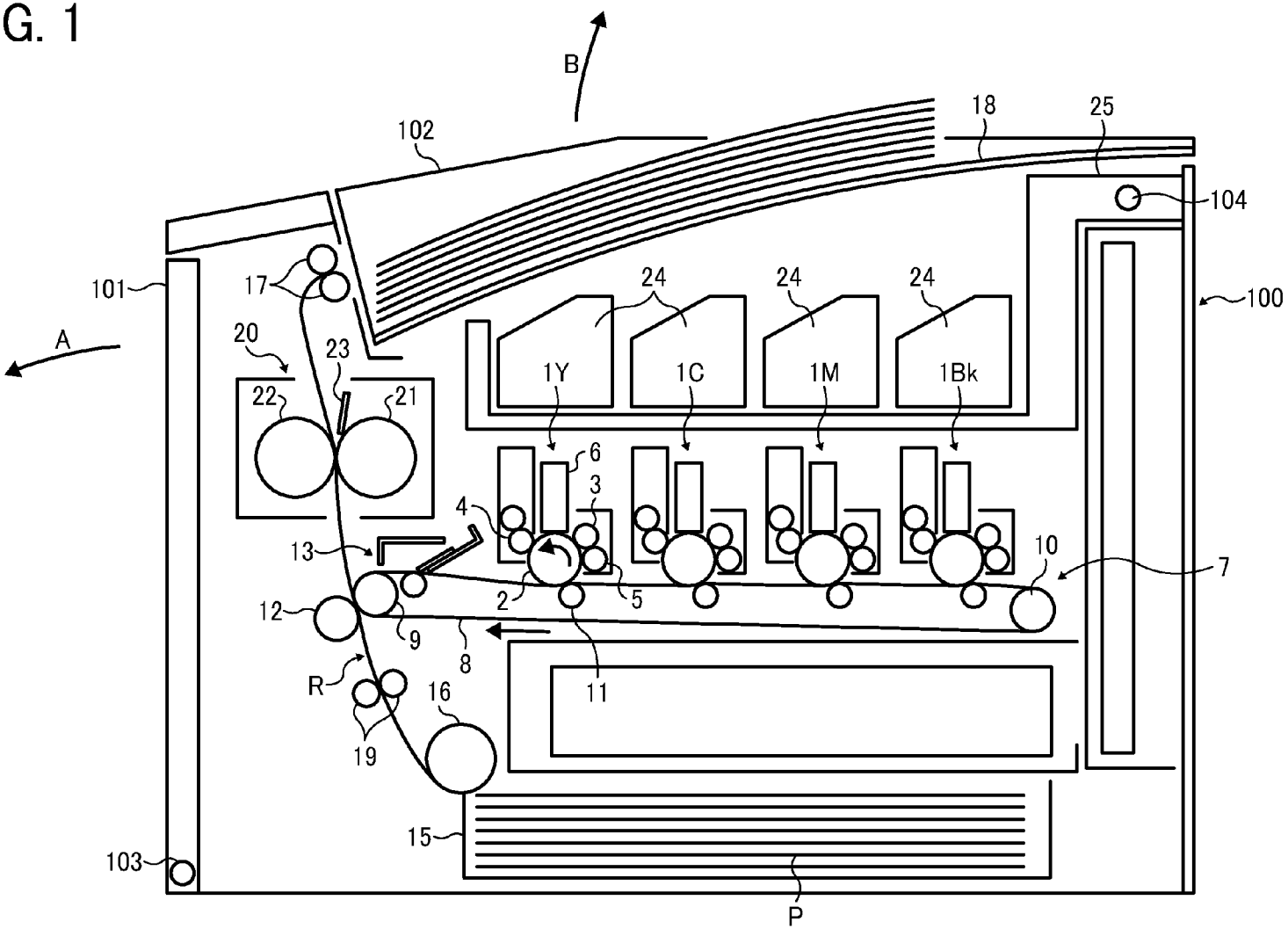
FIG. 1 shows a schematic configuration of a printer according to an embodiment of the present invention.

Hereinafter, the present invention will be described referring to the accompanying drawings. In each figure illustrating an embodiment of the present invention, a part or component having the same function or shape is given the same reference numeral, and once explained, a redundant description thereof will be omitted.

First, with reference to FIG. 1, an entire structure and operation of a printer according to an embodiment of the present invention will be described.

As illustrated in FIG. 1, four processing units 1Y, 1C, 1M, and 1Bk each as an image forming unit are detachably attached to a printer body or an image forming apparatus body 100. Each of the processing units 1Y, 1M, 1C, and 1Bk has the same structure except that each includes a different color of toner such as yellow (Y), magenta (M), cyan (C), and black (Bk) that corresponds to RGB color separation component of a color image.

Specifically, each of the processing units 1Y, 1C, 1M, and 1Bk includes an image carrier or a latent image carrier 2; a charger 3 to charge a surface of the image carrier 2; a developing device 4 to render the latent image on the image carrier 2 visible; and a cleaning device 5 to clean a surface of the image carrier 2. An exposure device or an electrostatic latent image forming device 6 to form a latent image on the surface of the image carrier 2 is disposed at a position opposite each image carrier 2. In FIG. 1, reference numerals are applied to those parts included in the processing unit 1Y for yellow alone, that is, the image carrier 2, the charger 3, the developing device 4, the cleaning device 5, and the exposure device 6, and the reference numerals for the other devices in the other processing units 1C, 1M, and 1Bk are omitted.

Each toner cartridge 24 serving as a powder container containing toner powders for image formation is disposed above each developing device 4 and is removable from an intermediate frame 25. The intermediate frame 25 is supported so as to be rotatable about a supporting point 104 disposed at the apparatus body 100. Each toner cartridge 24 includes the same color of toner as that of the toner inside the corresponding developing device 4. If the toner inside the developing device 4 becomes less than the predetermined amount, the toner is replenished from the toner cartridge 24. In the preferred embodiment according to the present invention, one-component developer containing toner particles alone is used; however, the present invention may be applied to a case in which two-component developer formed of toner particles and carrier particles is used.

A transfer device 7 is disposed below each image carrier 2. The transfer device 7 includes an intermediate transfer belt 8 being an endless belt as an intermediate transfer body. The intermediate transfer belt 8 is stretched over a drive roller 9 and a driven roller 10, each serving as a support member, and when the drive roller 9 rotates in the counterclockwise direction as shown in the figure, the intermediate transfer belt 8 is driven to rotate cyclically in a direction as indicated by an arrow in the figure.

Four primary transfer rollers 11 each are disposed at a position opposed to a corresponding one of the image carriers 2. Each primary transfer roller 11 presses an interior surface of the intermediate transfer belt 8 at each disposed position, and a primary transfer nip is formed at a position where the pressed portion of the intermediate transfer belt 8 contacts each image carrier 2. Each primary transfer roller 11 is connected to a power source, not shown, and is supplied with a predetermined direct current voltage (DC) and/or alternating current voltage (AC).

A secondary transfer roller 12 as a secondary transfer means is disposed at a position opposed to the drive roller 9. The secondary transfer roller 12 presses an external surface of the intermediate transfer belt 8 and a secondary transfer nip is formed at a position where the secondary transfer roller 12 contacts the intermediate transfer belt 8. In addition, similarly to the primary transfer rollers 11, the secondary transfer roller 12 is connected to the not-shown power source and is supplied with a predetermined direct current (DC) voltage and/or alternating current (AC) voltage.

In addition, a belt cleaner 13 configured to clean the surface of the intermediate transfer belt 8 is disposed on a circumferential surface of the intermediate transfer belt 8 at the left end in the figure.

A sheet tray 15 containing a sheet P as a recording medium and a sheet feed roller 16 to convey the sheet P from the sheet tray 15 are disposed in the bottom of the apparatus body 100. Herein, the sheet P includes various types of sheets such as a cardboard, a postcard, an envelope, plain paper, thin paper, coated paper or art paper, tracing paper, and the like. An OHP sheet or film may be used as a recording medium.

A pair of sheet ejection rollers 17 to eject the sheet outside the apparatus and a sheet discharge tray 18 to stack the sheet ejected by the pair of sheet ejection rollers 17 thereon, are disposed above the apparatus body 100.

In addition, a conveyance path R through which the sheet P is conveyed from the paper tray 15 via the secondary transfer nip to the sheet discharge tray 18 is disposed inside the apparatus body 100. In the conveyance path R, a pair of registration rollers 19 to convey the sheet P to the secondary transfer nip at an appropriate timing is disposed upstream of the secondary transfer roller 12 in the sheet conveyance direction.

A fuser 20 to fix an image onto the sheet P is disposed downstream of the secondary transfer roller 12 in the sheet conveyance direction. The fuser 20 includes a fuser roller 21, a pressure roller 22, and a separator 23. The fuser roller 21 serves as a fixing member heated by a heat source. The pressure roller 22 is disposed opposite the fuser roller 21 to press-contact it, thereby forming a fixing nip. The separator 23 separates a sheet from the fuser roller 21.

In the present embodiment, the fuser roller 21 and the pressure roller 22 contact each other with a pressing means, not shown, to thus form a fixing nip at the press-contact portion, but the present invention is not limited to the disclosed structure. For example, at least one of the fixing unit and the opposite member can be an endless belt, which can be contacted to the opposed member via a roller or a pad. In addition, the fuser and the opposed member are not contacted each other with pressure, but can only be contacted without being applied with pressure.

Next, with reference to FIG. 1, basic operation of the printer according to an embodiment of the present invention will be described.

When an image forming operation is started, each image carrier 2 of the processing units 1Y, 1C, 1M, and 1Bk rotates in the clockwise direction in FIG. 1 and a surface of each image carrier 2 is uniformly charged at a predetermined polarity by the charger 3. Based on the image data of the original read by an image reader, not shown, or from the computer, the exposure unit 6 exposes the charged surface of each photoreceptor 2 to form an electrostatic latent image on the surface of each photoreceptor 2. In this case, the image data exposed on each photoreceptor 2 is monochrome image data decomposed, from the target full-color image, into color data of yellow, magenta, cyan, and black. Thus, each developing device 4 supplies toner to the electrostatic latent image formed on the image carrier 2, and the electrostatic latent image is visualized as a toner image.

When the image forming operation is started, the drive roller 9 that is stretched around the intermediate transfer belt 8 is driven to rotate and the intermediate transfer belt 8 is driven to rotate in the direction indicated by an arrow in the figure. In addition, because the constant voltage or the constant-current controlled voltage with a polarity opposite that of the toner is applied to each of the primary transfer rollers 11, a transfer electric field is formed in the primary transfer nip between each of the primary transfer rollers 11 and each image carrier 2.

Thereafter, upon the toner image of each color formed on the image carrier 2 reaching the primary transfer nip associated with the rotation of each image carrier 2, the toner image of each color formed on each image carrier 2 is sequentially transferred in a superimposed manner on the intermediate transfer belt 8 by the transfer electric field formed at the primary transfer nip. Thus, a full-color toner image is carried on the surface of the intermediate transfer belt 8. In addition, the toner which has not been transferred to the intermediate transfer belt 8 and is remaining on each image carrier 2 is removed by the cleaning device 5.

The sheet feed roller 16 disposed in the bottom of the apparatus body 100 is started to rotate so that the sheet P is fed out from the paper tray 15 to the conveyance path R. The sheet P fed out to the conveyance path R is once stopped by a registration roller pair 19.

Then, the registration roller pair 19 starts to rotate at a predetermined timing, so that the sheet P is conveyed to the secondary transfer nip at a matched timing with which the toner image on the intermediate transfer belt 8 has reached the secondary transfer nip. In this case, because the transfer voltage having a polarity opposite that of the charged toner of the toner image on the intermediate transfer belt 12 is applied to the secondary transfer roller 12, a transfer electric field is formed at the secondary transfer nip. Through the electric transfer field formed at the secondary transfer nip, the toner image on the intermediate transfer belt 8 is transferred en bloc to the sheet P. In addition, the residual toner which has not been transferred to the sheet P and is remaining on the intermediate transfer belt 8 is removed by a belt cleaning device 13.

Thereafter, the sheet P onto which the toner image has been transferred is conveyed to the fuser 20 and the toner image on the sheet P is heated and pressed by the fuser roller 21 and the pressure roller 22, whereby the toner image on the sheet P is fixed on the sheet P. Then, the sheet P is separated from the fuser roller 21 by the separator 23, is discharged outside the apparatus by the pair of sheet discharge roller 17, and is stacked on the sheet discharge tray 18. The description above relates to an image forming operation when a full-color image is formed on the sheet. Alternatively, however, a monochrome image may be formed using any one of the four processing units 1Y, 1C, 1M, and 1Bk, as may an image with two or three colors using two or three processing units.

In addition, as illustrated in FIG. 1, the printer according to the present embodiment includes a front cover 101 as a first cover disposed at the front of the apparatus body 100 and a top cover 102 as a second cover disposed at the top of the apparatus body 100. The front cover 101 is configured to be openably closable by rotating about a support shaft 103 disposed beneath the front of the apparatus body 100. The top cover 102 is configured to be openably closable by rotating about a support shaft 104 which supports the intermediate frame 25.

Figure 2:
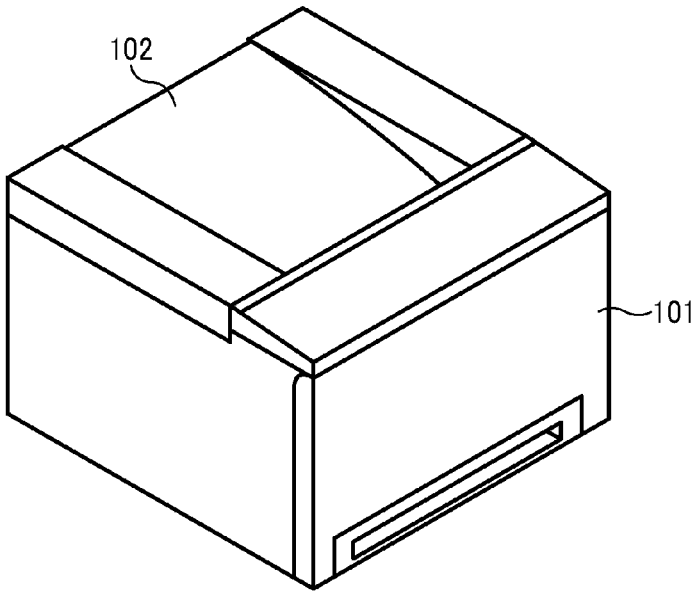
FIG. 2 is an external view of the printer with both a front cover and a top cover are closed.
Figure 3:
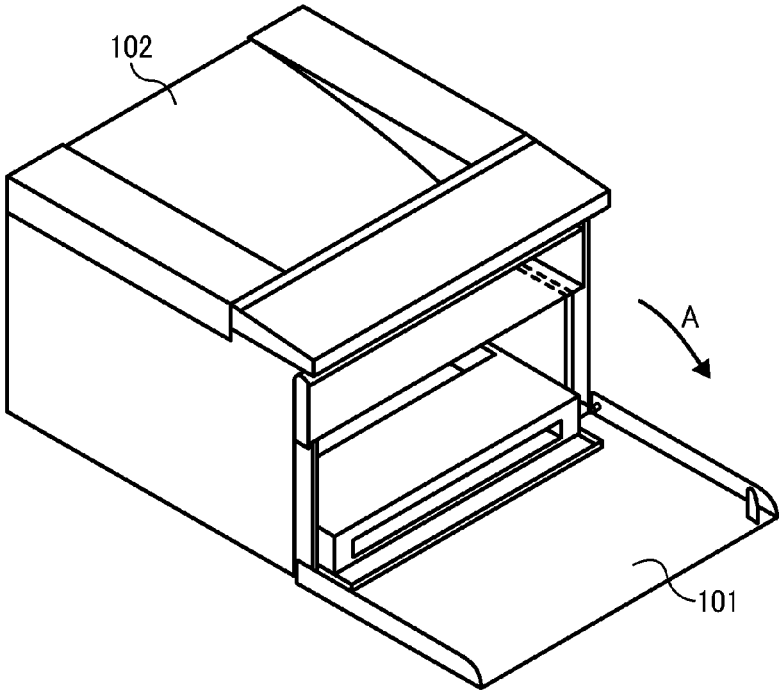
FIG. 3 is an external view of the printer with the front cover opened.

FIG. 2 is an external view of the printer with both the front cover 101 and the top cover 102 closed; FIG. 3 is an external view of the printer in which the front cover 101 is open; and FIG. 4 is an external view of the printer with the top cover 102 open.

As illustrated in FIG. 3, the front cover 101 is open by rotating it in A-direction. Thus, by opening the front cover 101, even though paper gets jammed, the jammed paper can be taken out from where the front cover 101 is open.

Figure 4:
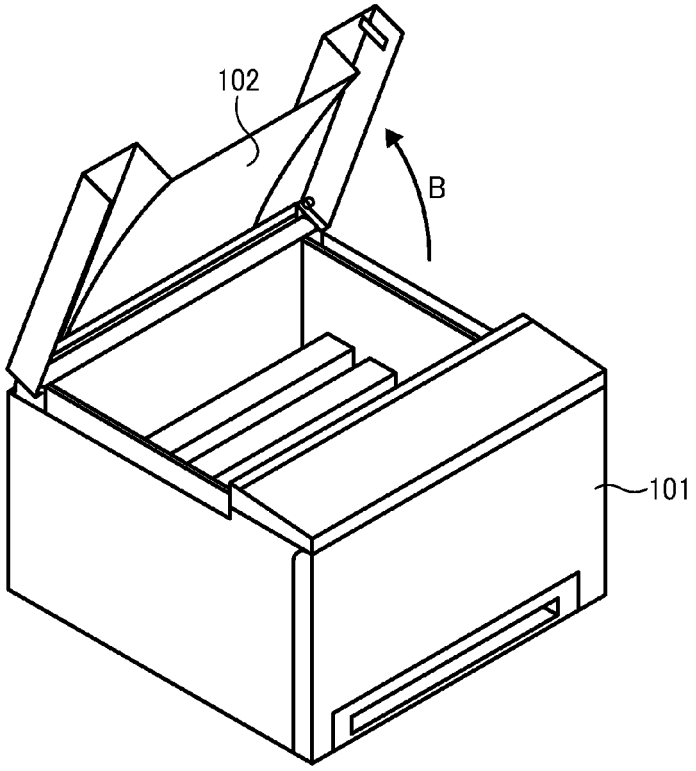
FIG. 4 is an external view of the printer with the top cover opened.

Further, as illustrated in FIG. 4, the top cover 102 can be open by rotating the top cover 102 in B-direction. Thus, by opening the front cover 102, each toner cartridge 24 can be attached to and detached from the apparatus body. Further, in a state in which the top cover 102 is opened, the intermediate frame 25 (see FIG. 1) can be rotated upward, thereby enabling the toner cartridge 24 to be evacuated at once from an area above the processing units 1Y, 1C, 1M, and 1Bk. As a result, each processing unit 1Y, 1C, 1M, or 1Bk can be attached or detached from the apparatus body from above.

Figure 5:
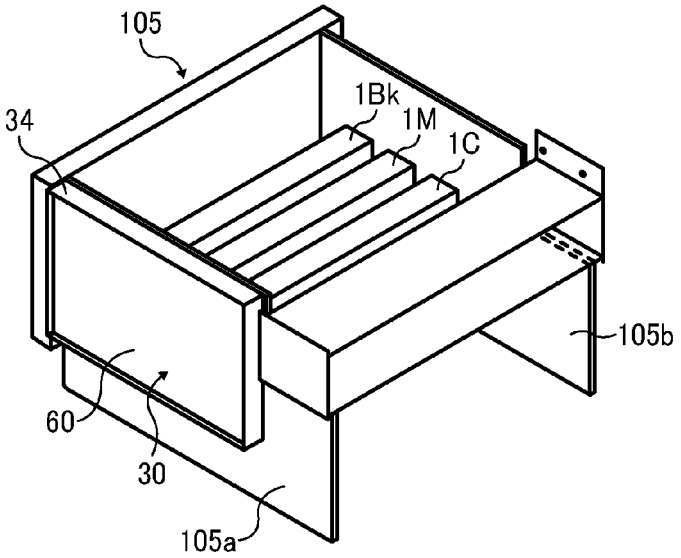
FIG. 5 is an external view of the printer when all external parts are removed.

FIG. 5 is a view of the printer when all external parts are removed.

As illustrated in FIG. 5, respective processing units 1Y, 1C, 1M, and 1Bk are attached at an inner side of a frame 105 of the printer. In addition, the frame 105 connects a pair of side plates 105*a*, 105*b*, and a power supply device 30 to feed power to the respective processing units 1Y, 1C, 1M, and 1Bk is disposed on the side plate 105*a*.

Figure 6:
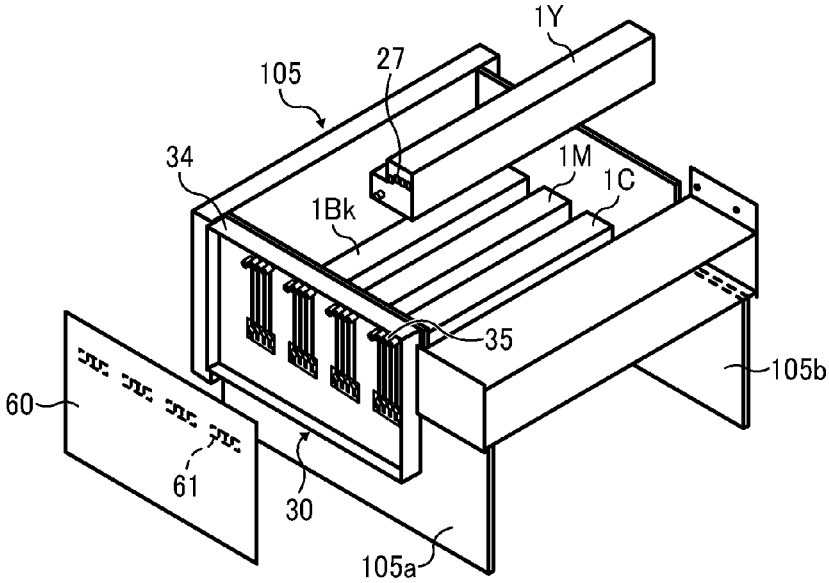
FIG. 6 is a view of the printer of FIG. 5 when processing units and a power supply board are removed.

As illustrated in FIG. 6, each of the processing units 1Y, 1C, 1M, and 1Bk includes a power-fed terminal 27. A power supply board 60 includes a power supply terminal 61. The power supply device 30 includes a power supply path 35 to conductively connect the power-fed terminal 27 and the power supply terminal 61; and a support member 34 formed as a rectangular frame, in which the power supply board 60 is embedded, so that the power supply board 60 is supported by the support member 34 (see FIG. 5).

Figure 7:
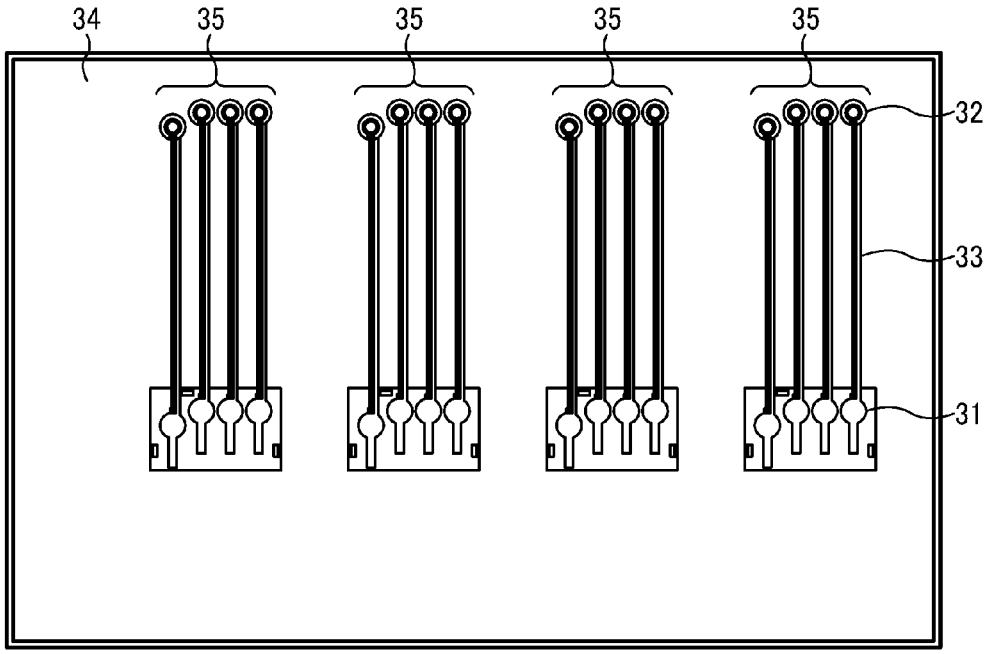
FIG. 7 is a perspective view of a power supply device.

As illustrated in FIG. 7, the power supply path 35 includes a unit contact portion 31 which can contact the power-fed terminal 27 of the processing units 1Y, 1C, 1M, and 1Bk; a board contact portion 32 which can contact the power supply terminal 61 of the power supply board 60; and a connector 33 to connect the unit contact portion 31 and the board contact portion 32. The unit contact portion 31 and the board contact portion 32 are formed of electrically conductive materials. The connector 33 is formed as a single integrated unit with the board contact portion 32. The unit contact portion 31 and the board contact portion 32 are conductively connected via the connector 33. In the present embodiment, one set of power supply path 35 includes four sets each of the unit contact portion 31, the board contact portion 32, and the connector 33. The four sets of power supply paths 35 correspond respectively to the four processing units 1Y, 1C, 1M, and 1Bk.

Figure 8:
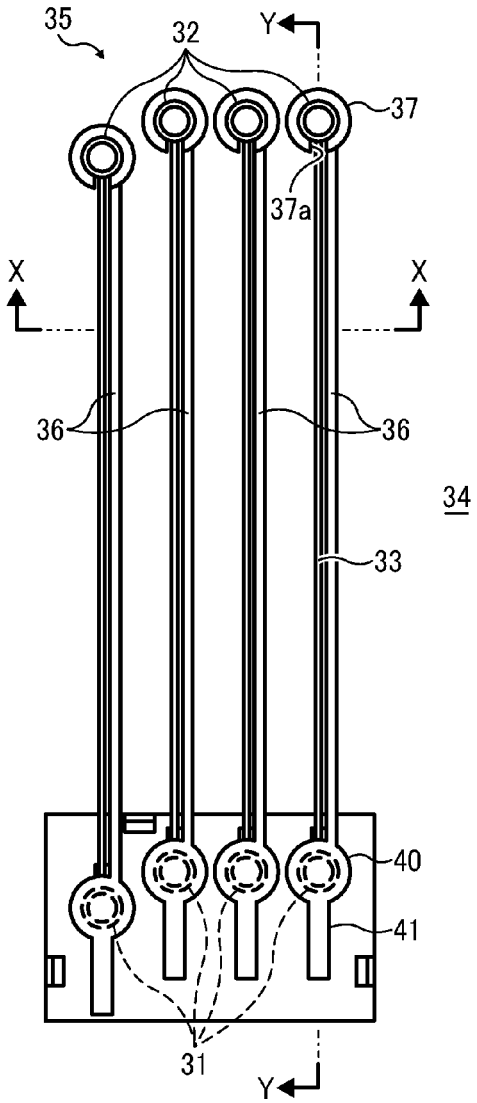
FIG. 8 is an external view of a power supply path.

FIG. 8 is an external view of the power supply path 35.

Each set of the power supply path 35 includes the same structure, and therefore, referring to FIG. 8, the structure of one set of the power supply path 35 will be described.

As illustrated in FIG. 8, each board contact portion 32 is attached at an upper part of the support member 34. By contrast, each unit contact portion 31 is disposed in the bottom of the support member 34. Then, each board contact portion 32 and each unit contact portion 31 are connected via a plurality of connectors 33 disposed vertically. In addition, each support member 34 includes a linear guide 36 to separate the plurality of connectors 33 from each other and to arrange them in parallel. Each guide 36 extends vertically and the connector 33 is disposed along the guide 36.

Figure 9:
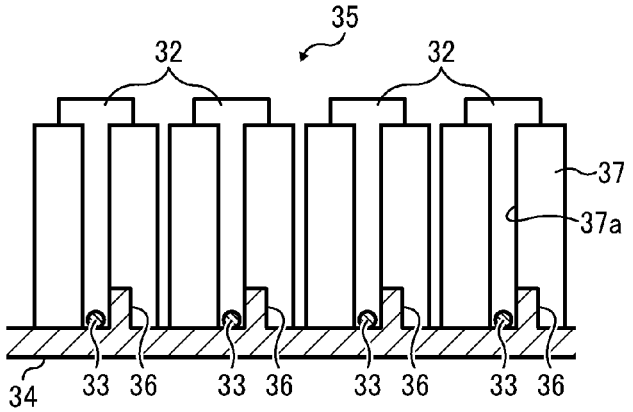
FIG. 9 is a horizontal cross-sectional view of the power supply path.

FIG. 9 is a cross-sectional view of the power supply path 35 dissected horizontally (that is, a cross section along X-X line in FIG. 8).

As illustrated in FIG. 9, each guide 36 is a projection extending from the support member 34. Because the projected guide 36 is disposed between adjacent connectors 33, the connectors 33 are prevented from contacting each other. In addition, each connector 33 does not contact any other even though bending or floating occurs in mounting the connector 33 to the support member 34. Accordingly, occurrence of a short circuit due to contact between the connectors 33 can be prevented.

Figure 10:
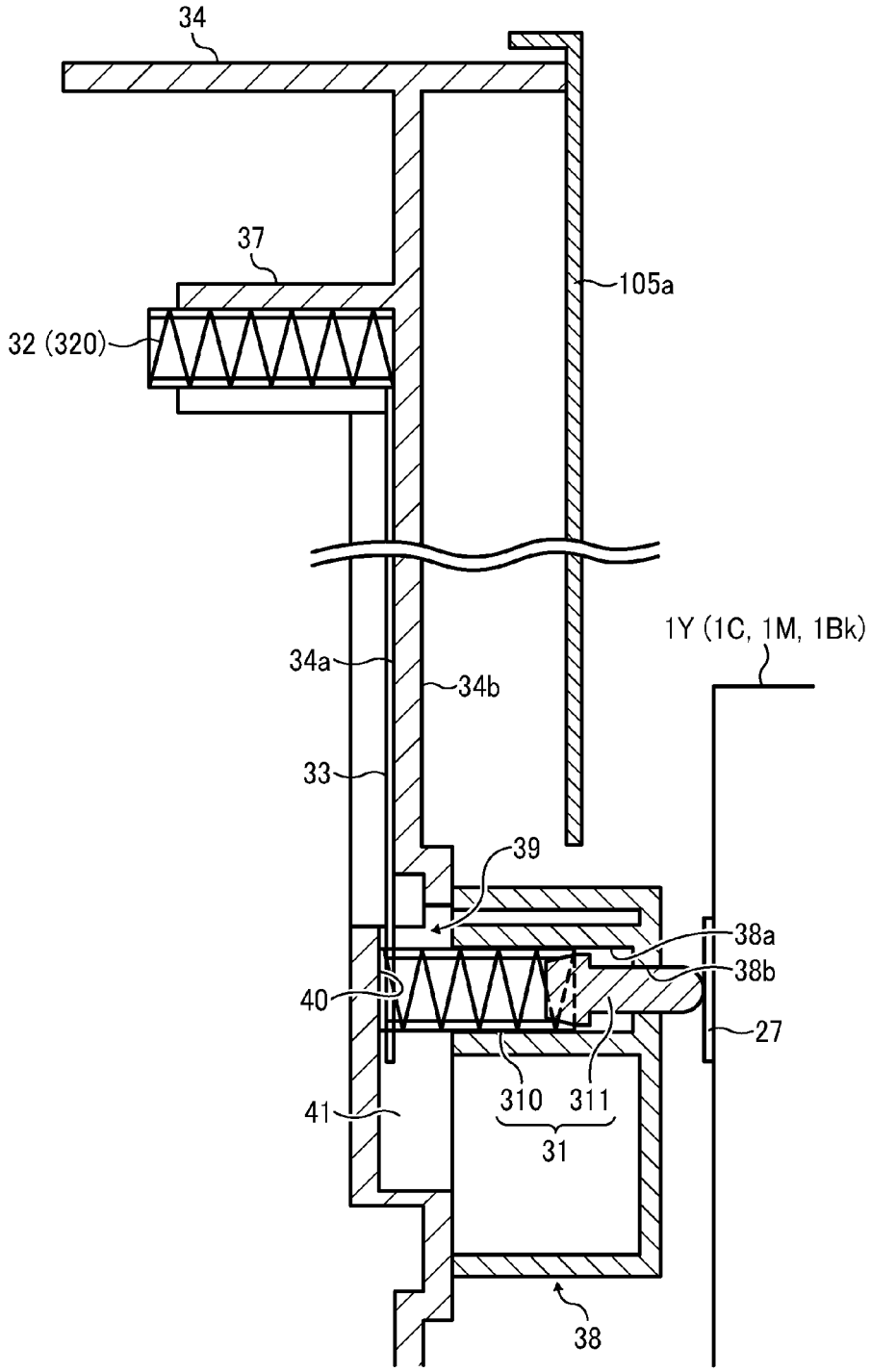
FIG. 10 is a vertical cross-sectional view of the power supply path.

FIG. 10 is a cross-sectional view of the power supply path 35 dissected horizontally (that is, a cross section along Y-Y line in FIG. 8).

As illustrated in FIG. 10, in the present embodiment, the board contact portion 32 is formed of a coil spring 320

(herein, a first coil spring 320). The first coil spring 320 is held on an outer surface 34*a* of the support member 34. The outer surface 34*a* is opposed to the power supply board 60. The first coil spring 320 is elastic in a direction substantially orthogonal to the outer surface 34*a*. As a result, when the power supply board 60 is attached to the support member 34, the power supply terminal 61 of the power supply board 60 (see FIG. 6) is pressed against and contacts an end of the first coil spring 320.

In addition, the board contact portion 32 is inserted into a cylindrical holder 37 extending from the outer surface 34*a* of the support member 34 and is held inside the holder 37. The holder 37 includes a slit 37*a*, through which the connector 33 connecting to a base part of the board contact portion 32 passes (see FIGS. 8 and 9).

By contrast, each unit contact portion 31 is held on an inner surface 34*b* of the support member 34 opposed to the processing units 1Y, 1C, 1M, and 1Bk. Specifically, the unit contact portion 31 and the board contact portion 32 are held on opposite surfaces of the support member 34. In the present embodiment, the unit contact portion 31 is formed of a coil spring 310 (herein, a second coil spring 310) and a metal terminal 311 disposed at a leading end of the second coil spring 310. Because an inner diameter of the leading end of the second coil spring 310 is slightly smaller than the outer diameter of the terminal 311, the terminal 311 can be pressed into the leading end of the second coil spring 310 thereby facilitating assembly.

The second coil spring 310 and the terminal 311 are held by a holder 38 disposed on an inner surface 34*b* of the support member 34. More specifically, a recessed retainer 38*a* is disposed in the holder 38, and the second coil spring 310 and the terminal 311 are included in the retainer 38*a*. A leading end of the terminal 311 is projected from an opening 38*b* disposed on the bottom of the retainer 38*a*. The second coil spring 310 is elastically deformable in a direction substantially orthogonal to the inner surface 34*b* of the support member 34 upon installation in the retainer 38*a*.

Figure 11:
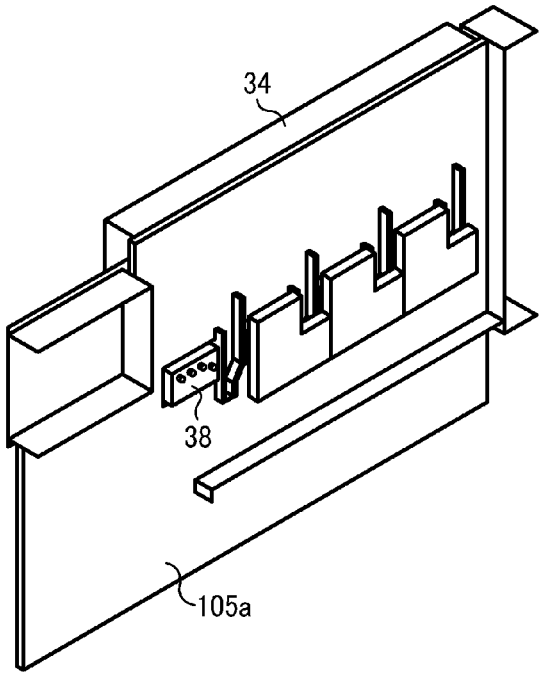
FIG. 11 shows a side plate, seen from an inside, on which a support member is disposed.
Figure 12:
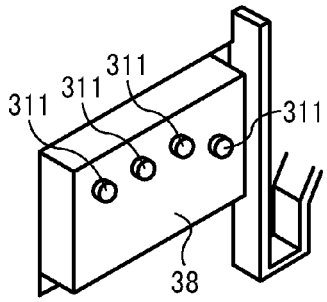
FIG. 12 is an enlarged view illustrating a main part of FIG. 11.

FIG. 11 is a view illustrating the side plate 105*a* seen from an inner side, on which the support member 34 is disposed. FIG. 12 is an enlarged view of the main part of FIG. 11.

As illustrated in FIGS. 11 and 12, leading ends of the plurality of terminals 311 protrude from the holder 38 to an inner side of the support member 34.

Figure 13:
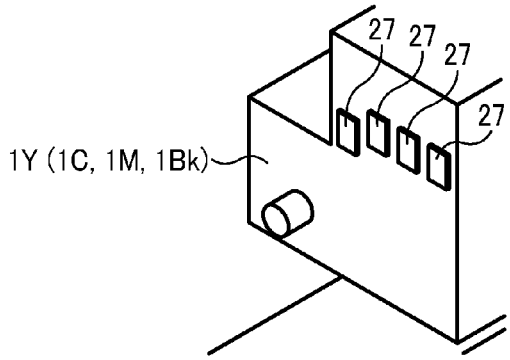
FIG. 13 is a partial view of the processing unit at one side thereof.

FIG. 13 shows a partial view of the processing units 1Y, 1C, 1M, and 1Bk at one side thereof.

As illustrated in FIG. 13, a plurality of power-fed terminals 27 are disposed on one side the processing units 1Y, 1C, 1M, and 1Bk. In the present embodiment, four power-fed terminals 27 are provided to correspond to the number of terminals 311 protruding from the holder 38.

As illustrated in FIG. 10, when the processing units 1Y, 1C, 1M, and 1Bk are attached to the apparatus body, the power-fed terminals 27 of the processing units 1Y, 1C, 1M, and 1Bk contact the leading ends of the terminals 311. Because at this time the terminal 311 is pressed toward the power-fed terminal 27 due to a biasing force of the second coil spring 310, contact between the terminal 311 and the power-fed terminal 27 is secured. As described above, the second coil spring 310 does not directly contact the power-fed terminal 27, but is allowed to contact via the metallic terminal 311 to the power-fed terminal 27, thereby preventing abrasion or damage to the unit contact portion 31 due to attachment or detachment of the processing units 1Y, 1C, 1M, and 1Bk to the apparatus body.

Further, as illustrated in FIG. 10, the support member 34 includes a through-hole 39 though which the connector 33 passes from the outer surface 34*a* to the inner surface 34*b*. Thus, the connector 33 is disposed to pass through the support member 34 so that the first coil spring 320 and the second coil spring 310 disposed at opposite surfaces of the support member 34 are connected with each other.

A receiving member 40 to seat the base of the second coil spring 310 is disposed on the inner surface 34*b* of the support member 34. The receiving member 40 is formed of a circular part protruding toward the outer surface 34*a* (see FIG. 8).

In addition, a connector space 41 that extends from the receiving member 40 downward is disposed on the inner surface 34*b* of the support member 34. As illustrated in FIG. 10, the connector space 41 accommodates an end of the connector 33 when the connector 33 extends downward beyond the second coil spring 310. With this configuration, even when the length of the connector 33 is longer than that of the mounting path length between the first coil spring 320 and the second coil spring 310, the connector 33 can still be mounted. Accordingly, even when the mounting path length of the connector 33 is different, by providing the connector 33 having a length corresponding to the longest mounting path length, the unit contact portion 31 and the board contact portion 32 can still be connected using the connector 33.

In addition, in the present embodiment, in the portion around the receiving member 40 and the connector space 41, the receiving member 40 is disposed at a position protruding toward the outside of the outer surface 34*a*. As a result, when the connector 33 is inserted into the through-hole 39, there is no need of bending or folding the connector 33 and the connector 33 can be disposed linearly.

Figure 14:
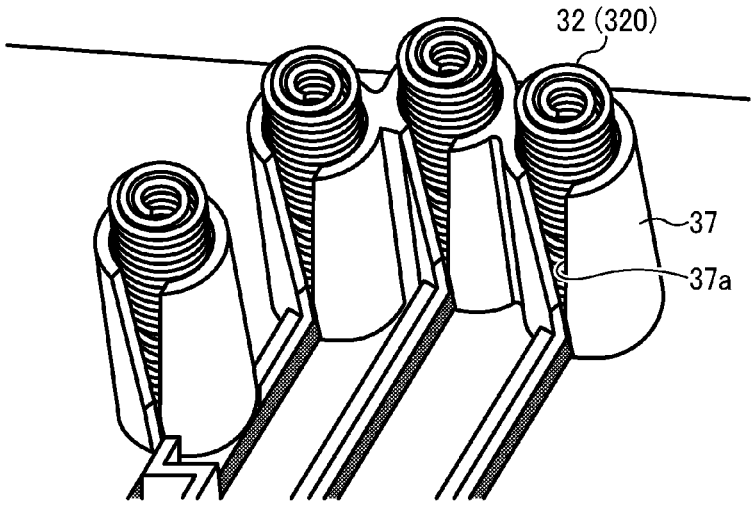
FIG. 14 is an enlarged view of a portion contacting the power supply board.

FIG. 14 is an enlarged view of the board contact portion 32.

As illustrated in FIG. 14, a leading end of the first coil spring 320 forming the board contact portion 32 is tapered, that is, the diameter of the spring 320 gradually lessens toward its leading end. As configured above, when the first coil spring 320 is shaped to have a tapered leading end, the first coil spring 320 can contact the power supply terminal 61 with connection terminals such as jumper cables disposed on the power supply board 60 at multiple contact points, thereby stabilizing power supply.

Figure 15:
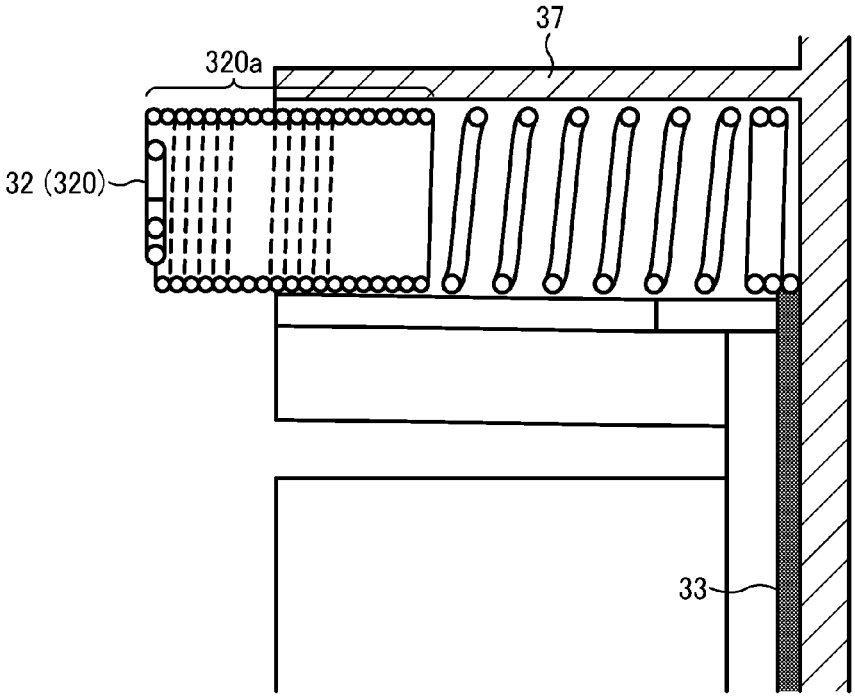
FIG. 15 is a cross-sectional view of a portion contacting the power supply board.

FIG. 15 is a cross-sectional view of the board contact portion 32.

As illustrated in FIG. 15, the first coil spring 320 includes an end turn 320*a* wound to contact the spring with no compression at its leading end. The end turn 320*a* includes one end protruding from the cylindrical holder 37 and the other end inserted into the holder 37. Because the end turn 320*a* is disposed inside the holder 37, the first coil spring 320 does not get caught on an edge of the leading end of the holder 37. Thus, the first coil spring 320 is prevented from being bent when mounting the power supply board 60 to the support member 34.

Figure 16:
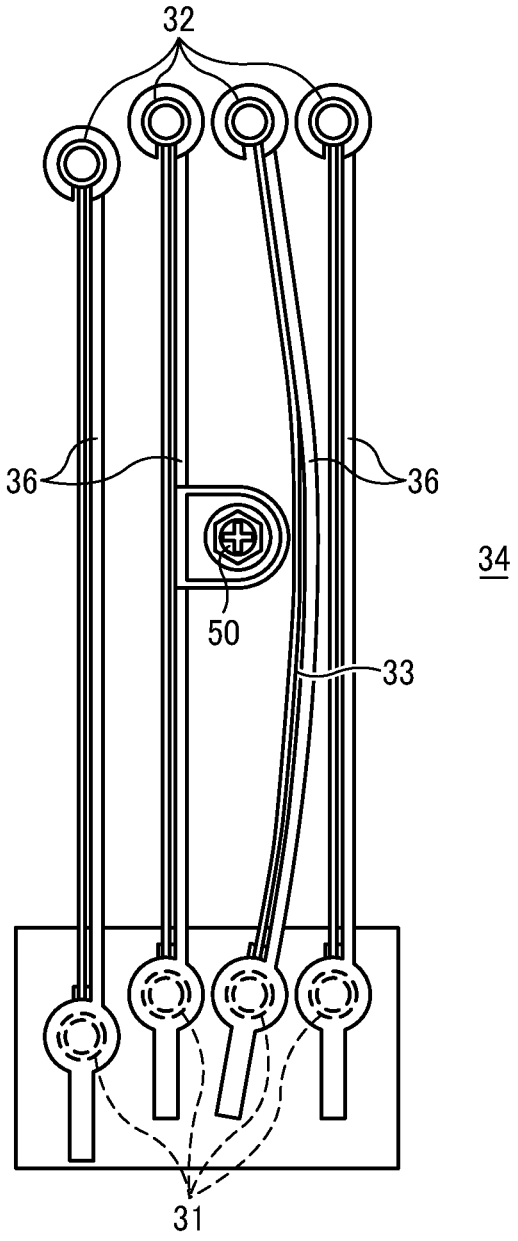
FIG. 16 shows a configuration including a partially curved connector.

Further, as illustrated in FIG. 16, when a screw 50 is used in the mounting path of the connector 33, the connector 33 can be curved or bent to prevent the connector 33 from contacting the screw 50 resulting in electrical leak. Further, in this case, because the guide 36 is curved and the connector 33 is arranged along the guide 36, contact between the connector 33 and the screw 50 can be prevented. By forming as above, the shape of the guide 36 can be appropriately changed in accordance with the mounting path of the connector 33. Further, as illustrated in FIG. 16, when only a part of the connector 33 alone is curved, the mounting path length of the connector 33 varies. In such a case, provision of the connector space 41 allows use of connectors 33 of the same length.

In FIG. 16, a case in which the connectors 33 are disposed in a curve on a plane parallel to the outer surface 34*a* which is opposite the power supply board. However, alternatively, the connectors 33 can be disposed in a curve even on a plane orthogonal to the outer surface 34*a*. With this configuration, the receiving member 40 can be disposed at any arbitrary position relative to the outer surface 34*a*.

Figure 17:
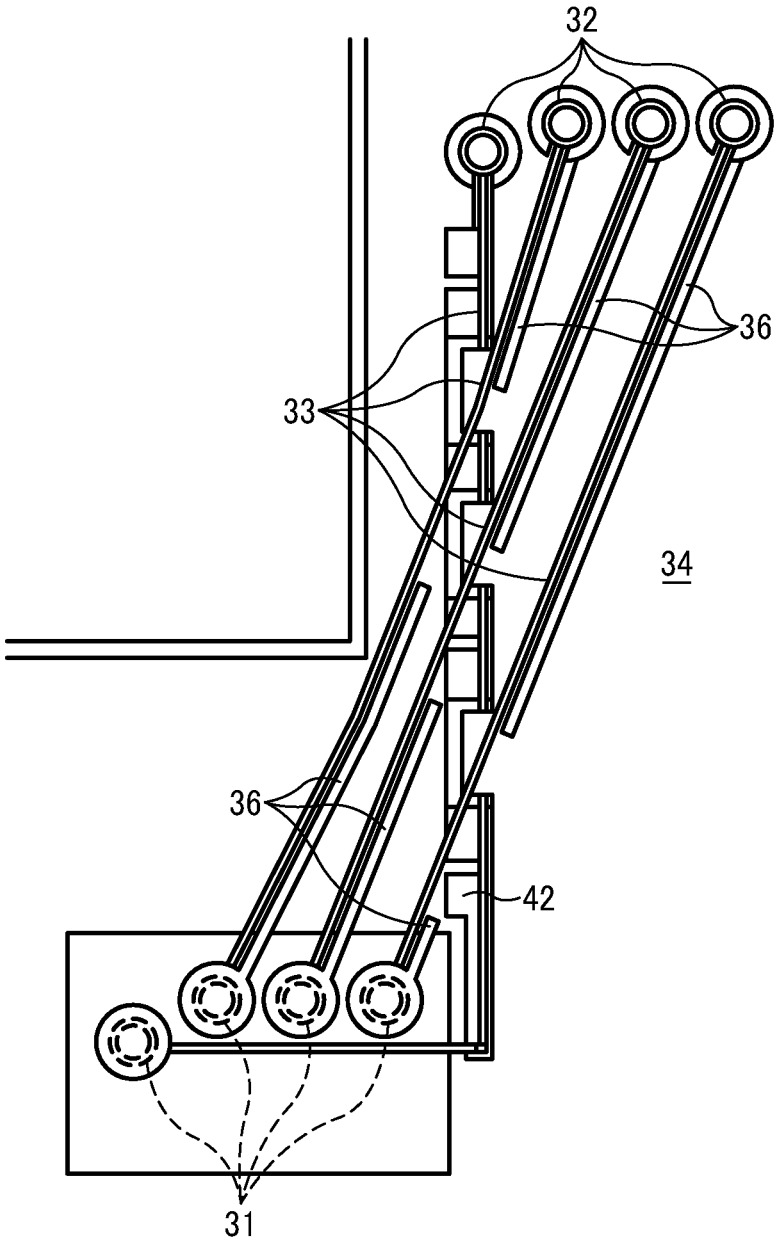
FIG. 17 shows a configuration including a crossing connector.
Figure 18:
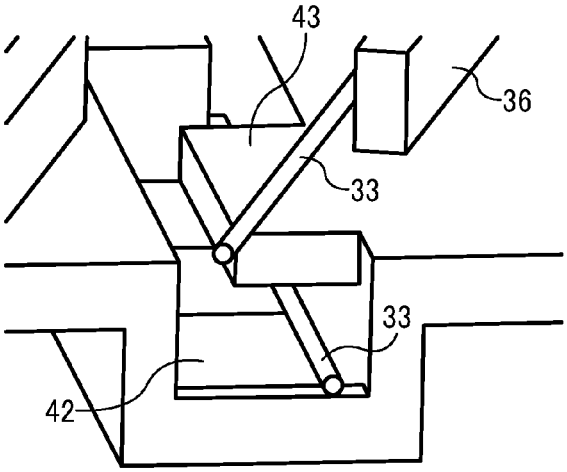
FIG. 18 is an enlarged view of a portion at which connectors intersect each other.

FIG. 17 shows a structure in which the connectors 33 are so disposed as to intersect the support frame 34 and FIG. 18 shows an enlarged view of a portion at which the connectors 33 intersect one another.

In the example as illustrated in FIG. 17, the leftmost connector 33 intersects with the other connectors 33. Specifically, when the leftmost connector 33 is disposed inside a groove-like recessed portion 42 formed in the support member 34, the same connector 33 is disposed on a plane different from the plane for the other connectors 33, so that the connectors 33 intersect each other.

In the portion where the connectors 33 intersect each other as illustrated in FIG. 18, a separator 43 to prevent contact between the connectors 33 is disposed. The separator 43 protrudes to cover an opening of the recessed portion 42. The separator 43 supports the connector 33 which intersects the recessed portion 42 and prevent the connector 33 from falling into the recessed portion 42 as well as prevents the connector 33 disposed inside the recessed portion 42 from flying over. Accordingly, the connectors 33 intersecting one another can be separated, so that occurrence of a short-circuit due to contact between the connectors 33 can be prevented.

Hereinafter, referring to FIGS. 19 to 23, another embodiment of the present invention will be described.

Figure 19:
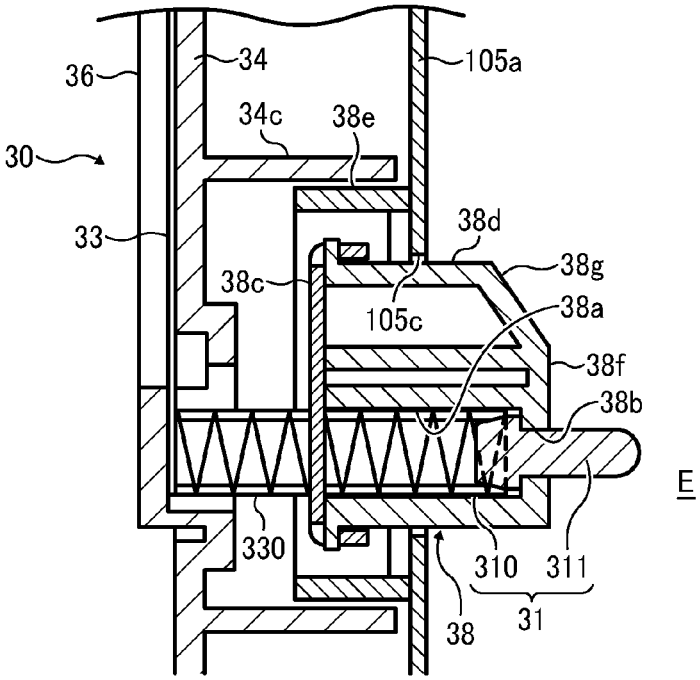
FIG. 19 is a view illustrating another embodiment of the present invention and shows a state in which the processing units are mounted in the printer body.
Figure 20:
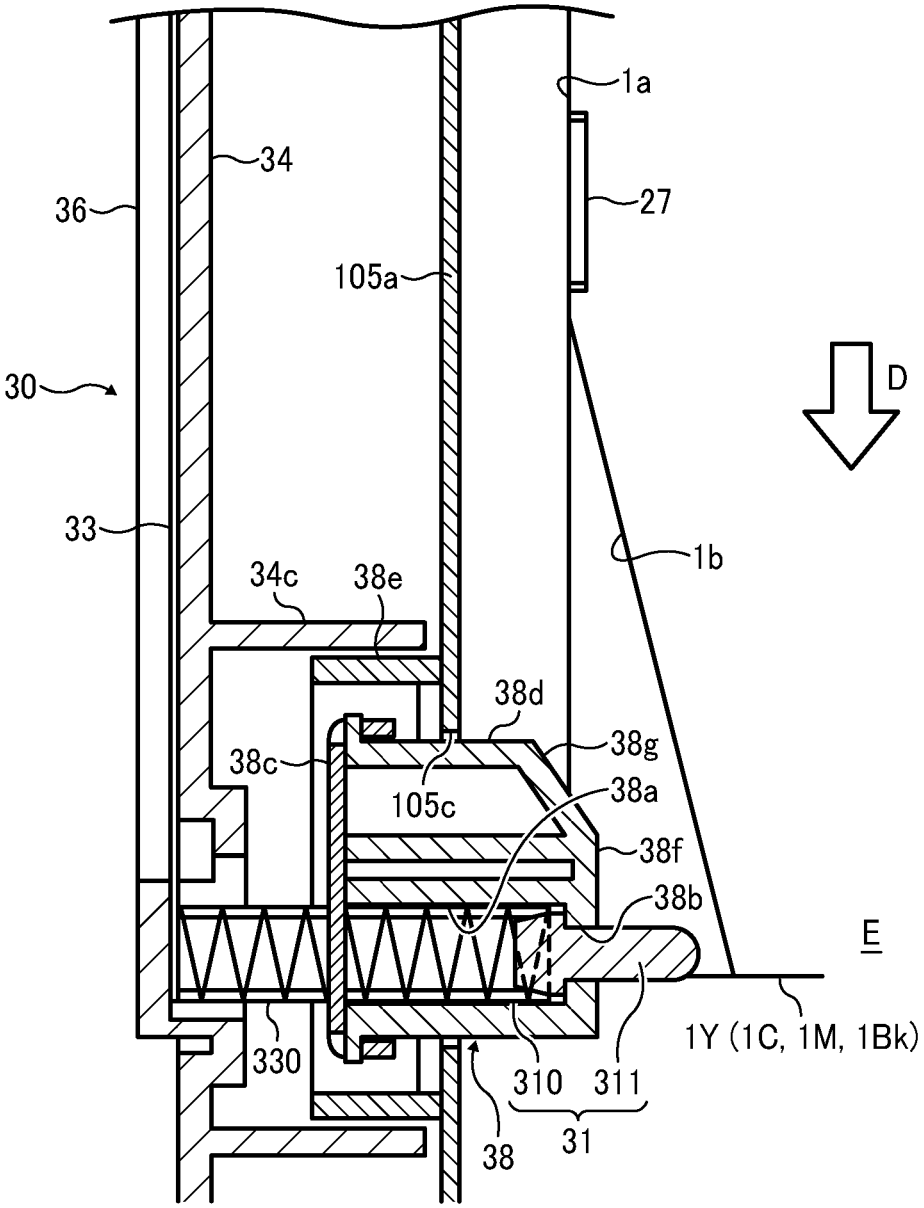
FIG. 20 is a view illustrating another embodiment of the present invention and shows an interim state of mounting the processing unit to the printer body.
Figure 21:
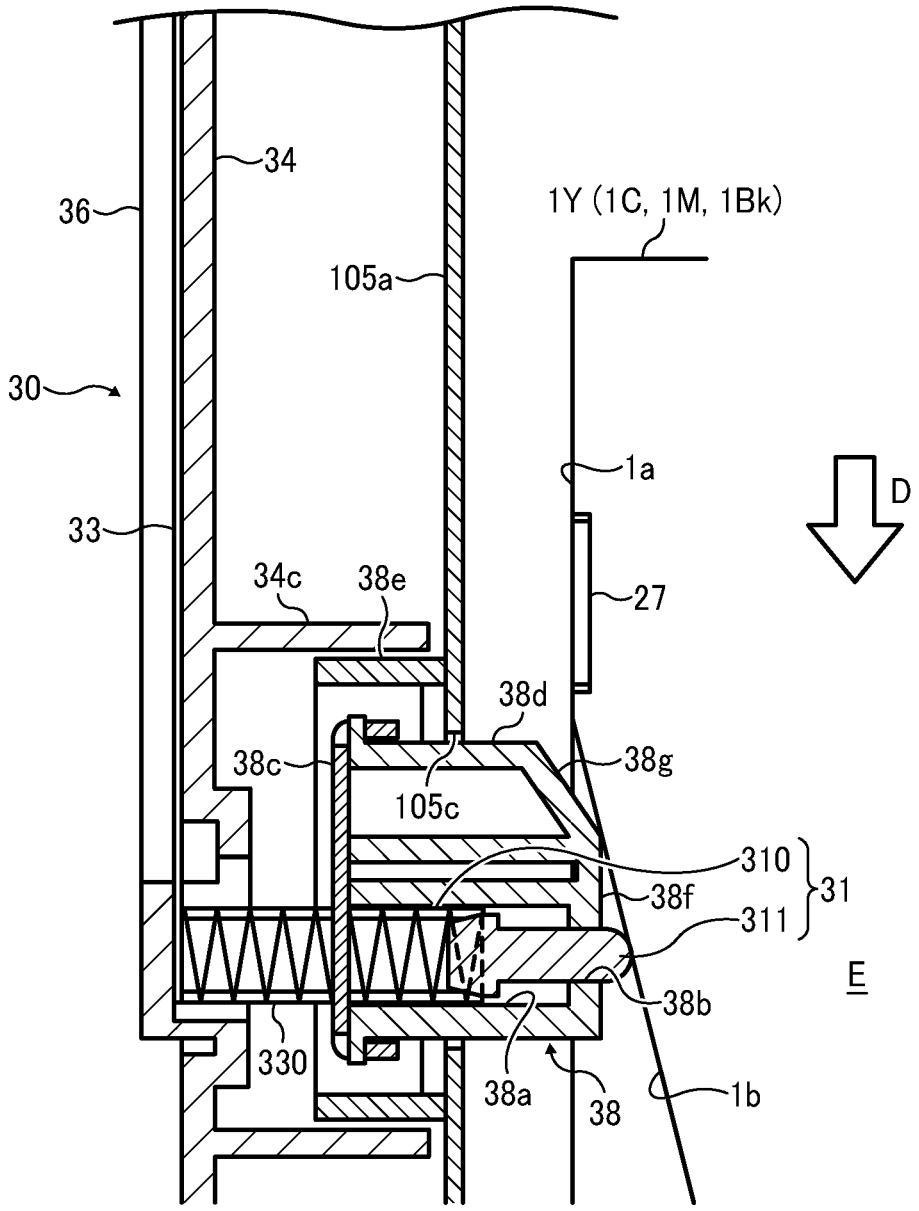
FIG. 21 is a view illustrating a state in which the processing unit is further inserted into the printer body.
Figure 22:
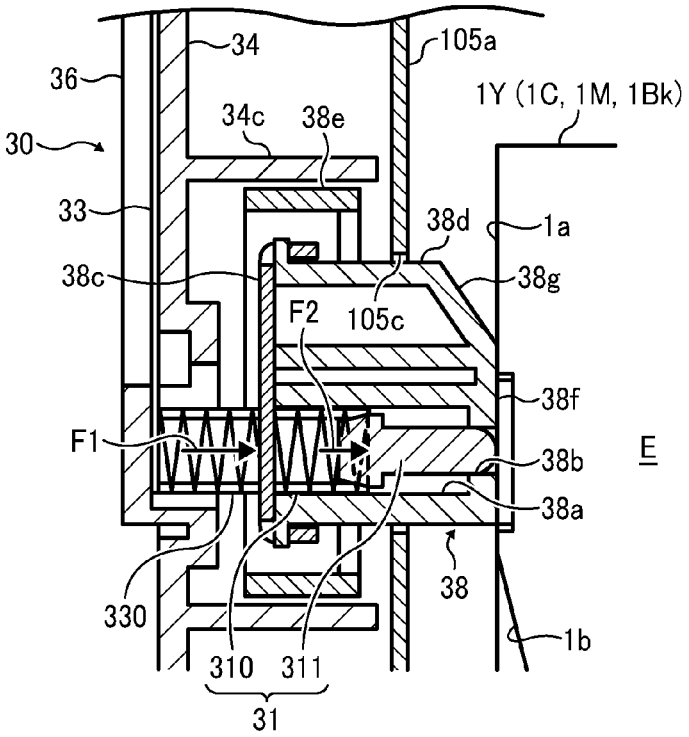
FIG. 22 is a view illustrating a state in which the processing unit is mounted to the printer body completely.
Figure 23:
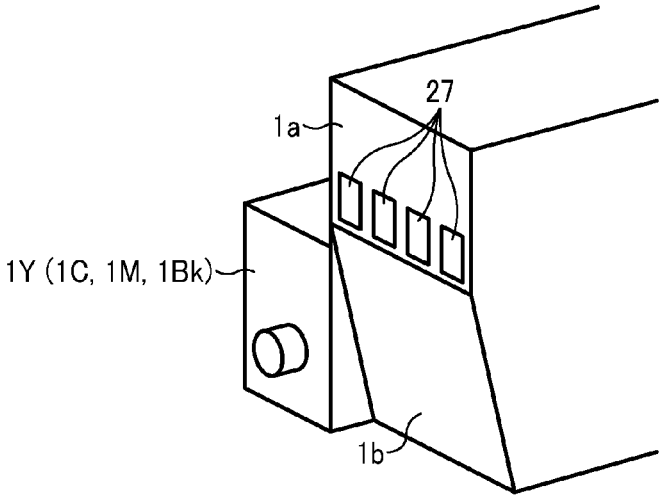
FIG. 23 is a partial view of the processing unit at one side thereof according to another embodiment of the present invention.

FIG. 19 is a view illustrating a state in which the processing units are not mounted in the printer body; FIG. 20 is a view illustrating an interim state of mounting the processing unit to the printer body; FIG. 21 is a view illustrating a state in which the processing unit is further inserted into the printer body; and FIG. 22 is a view illustrating a state in which the processing unit is mounted to the printer body completely. FIG. 23 shows a partial view of the processing units 1Y, 1C, 1M, and 1Bk at one side thereof.

As illustrated in FIGS. 19 to 22, in the present embodiment, the holder 38 disposed in the power supply device 30 is configured to be movable in the lateral direction. Specifically, the holder 38 is movable in a direction crossing the unit attachment direction D in which the processing unit 1Y (1C, 1M, 1Bk) is attached to the printer body; and is movable in a direction approaching and separating from the unit attachment area E to which the processing unit 1Y (1C, 1M, 1Bk) is attached. The unit attachment area E is an area into which the processing unit is ultimately fitted upon completion of mounting to the printer body (see FIG. 22). In addition, the support member 34 is provided with a holder guide 34*c* to guide the holder 38 in a direction approaching or separating from the unit attachment area E.

The holder 38 supports the unit contact portion 31 formed of the metallic terminal 311 and the second coil spring 310. The second coil spring 310 serves as a biasing member that presses against the terminal 311 toward the unit attachment area E. More specifically, the terminal 311 and the second coil spring 310 are included in the recessed retainer 38*a* disposed in a holder body 38*d*. A leading end of the terminal 311 protrudes from the opening 38*b* disposed in the bottom of the retainer 38*a* and the terminal 311 is movable in the direction approaching and separating from the unit attachment area E independently from the holder 38. In addition, a retention plate 38*c* is disposed at an open side of the retainer 38*a* of the holder body 38*d*. The second coil spring 310 is held by the retention plate 38*c* in a compressed state. Thus, in the present embodiment, the terminal 311 and the second coil spring 310 are installed in the holder body 38*d*, and further, the retention plate 38*c* is mounted to the holder body 38*d*, so that all parts are integrally assembled as a single contact unit.

The holder 38 is pressed toward the unit attachment area E by a third coil spring 330, which acts as a holder biasing member. The third coil spring 330 is disposed coaxially with the second coil spring 310 via the retention plate 38*c* and is compressed between the retention plate 38*c* and the support member 34. Further, a leading end of the third coil spring 330 facing the support member 34 contacts one end of the connector 33 as described above. The second coil spring 310, the third coil spring 330, and the retention plate 38*c* each are formed of electrically conductive materials. Then, via the parts described above and the connector 33, the similarly-configured first coil spring 320 (see FIG. 10) and the terminal 311 are connected conductively. In addition, the end of the third coil spring 330 facing the support member 34 is wound like a pigtail (see FIG. 14) similarly to the first coil spring 320. Thus, the third coil spring 330 can contact the support member 34 at plural contact points, thereby provided more stable power supply.

The holder 38 is pressed toward the unit attachment area E by the third coil spring 330, so that the holder 38 protrudes from an opening 105*c* formed on the side plate 105*a* toward the unit attachment area E. The protrusion of the holder 38 from the side plate 105*a* is restricted due to contact between a restrictor 38*e* of the holder 38 and the side plate 105*a*. In a state in which the holder 38 maximally protrudes from the side plate 105*a*, the holder 38 is disposed at a position contacting the processing unit 1Y (1C, 1M, 1Bk).

Further, a parallel face 38*f* parallel to the unit attachment direction D and a slanted face 38*g* slanting with respect to the unit attachment direction D and disposed upstream of the parallel face 38*f* configure the surface of the holder 38 facing the unit attachment area E. Specifically, the slanted surface 38*g* is slanted to approach the unit attachment area E toward downstream of the unit attachment direction D. In addition, the parallel face 38*f* includes the opening 38*b* from which the terminal 311 protrudes.

On the other hand, the side face of the processing unit 1Y (1C, 1M, 1Bk) facing the power supply device 30 includes a parallel face 1*a* parallel to the unit attachment direction D and a slanted face 1*b* slanting with regard to the unit attachment direction D and disposed downstream of the parallel face 1*a* in the unit attachment direction D. Specifically, the slanted surface 1*b* is slanted to approach the power supply device 30 toward downstream of the unit attachment direction D. In addition, the power-fed terminal 27 is exposed from the parallel face 1*a*.

Next, attachment of the processing unit will be described with reference to FIGS. 20 to 23.

As illustrated in FIG. 20, when the processing unit 1Y (1C, 1M, 1Bk) is inserted downward (i.e., in the direction indicated by arrow D), the holder 38 and the terminal 311 that protrude toward the unit attachment area E contact the processing unit 1Y (1C, 1M, 1Bk). As the processing unit 1Y (1C, 1M, 1Bk) is inserted gradually, the holder 38 and the terminal 311 slide along the slanted face 1*b* of the processing unit 1Y (1C, 1M, 1Bk) and are pushed laterally into the support member 34. As illustrated in FIG. 22, when the processing unit 1Y (1C, 1M, 1Bk) is completely mounted, the parallel face 38*f* of the holder 38 and the parallel face 1*a* of the processing unit 1Y (1C, 1M, 1Bk) contact and the terminal 311 contacts the power-fed terminal 27.

In the present embodiment, a biasing force F1 of the third coil spring 330 pressing the holder 38 is set greater than a biasing force F2 of the second coil spring 310 pressing the terminal 311 (see FIG. 22). As a result, as illustrated in FIG.

22, the holder 38 is kept in contact with the processing unit 1Y (1C, 1M, 1Bk) due to the greater biasing force of the third coil spring 330. On the other hand, because the biasing force of the second coil spring 310 is relatively small, the terminal 311 is restrained and does not protrude from the parallel face 38*f* of the holder 38.

Thus, in the present embodiment, because the biasing force F1 of the third coil spring 330 is set greater than the biasing force F2 of the second coil spring 310, even though the attachment position of the processing unit 1Y (1C, 1M, 1Bk) shifts in the longitudinal direction or in the lateral direction in FIG. 22, the holder 38 remains in contact with the processing unit 1Y (1C, 1M, 1Bk). As a result, the terminal 311 is retained in a state not protruding from the parallel face 38*f* of the holder 38 even though the positions of the processing unit 1Y (1C, 1M, 1Bk) may deviate. Specifically, when the processing unit 1Y (1C, 1M, 1Bk) is mounted, the compression amount of the second coil spring 310 pressing the terminal 311 is always constant regardless of the attachment position of the processing unit 1Y (1C, 1M, 1Bk), so that the contact pressure of the terminal 311 relative to the power-fed terminal 27 is constant. As a result, in the present embodiment, stable power supply can be provided.

Figure 24:
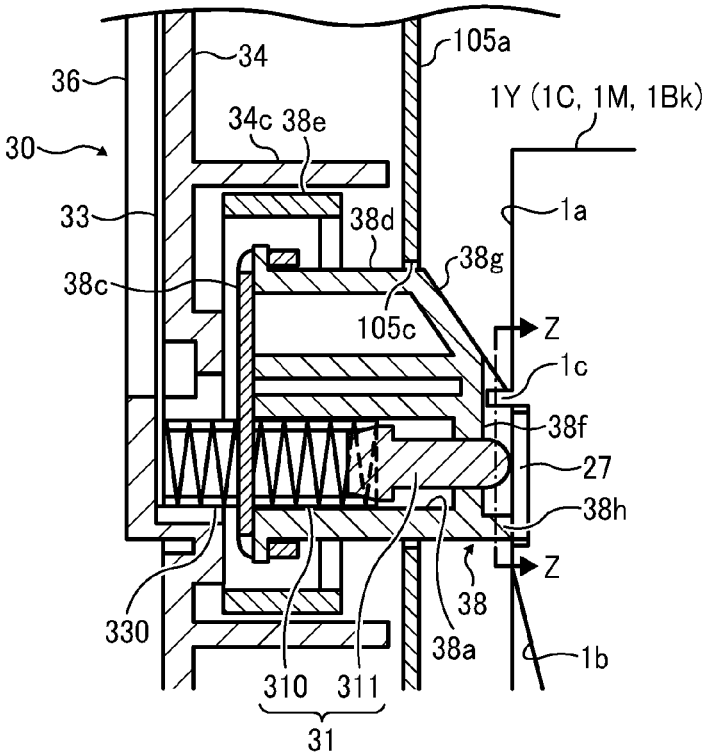
FIG. 24 is a view illustrating further another embodiment of the present invention and shows a state in which the processing unit is mounted to the printer body completely.

FIG. 24 is a cross-sectional view illustrating further another embodiment of the present invention.

FIG. 24 shows a state in which the processing unit 1Y (1C, 1M, 1Bk) is mounted, and the holder 38 includes a projecting wall 38*h* disposed on the parallel face 38*f* facing the processing unit 1Y (1C, 1M, 1Bk). With this structure, in the present embodiment, the projecting wall 38*h* contacts the processing unit 1Y (1C, 1M, 1Bk).

In the embodiment as illustrated in FIG. 22, the holder 38 contacts the processing unit 1Y (1C, 1M, 1Bk) across the entire parallel face 38*f*. By contrast, in the embodiment as illustrated in FIG. 24, the projecting wall 38*h* contacts the processing unit 1Y (1C, 1M, 1Bk) over a smaller contact area. As a result, friction resistance when the processing unit 1Y (1C, 1M, 1Bk) is attached or detached is reduced, thereby improving operability.

Further, in the embodiment as illustrated in FIG. 24, the processing unit 1Y (1C, 1M, 1Bk) includes a projected portion 1*c* on the parallel face 1*a* facing the holder 38. The projected portion 1*c* protrudes to face or contact the parallel face 38*f* of the holder 38 in a state in which the processing unit 1Y (1C, 1M, 1Bk) is attached.

Figure 25:
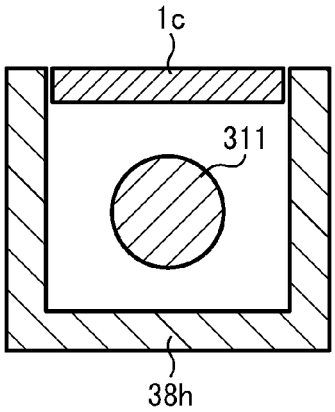
FIG. 25 shows a cross-sectional view along Line Z-Z in FIG. 24.

FIG. 25 shows a cross-sectional view along Line Z-Z in FIG. 24.

As illustrated in FIG. 25, in a state in which the processing unit 1Y (1C, 1M, 1Bk) is attached, the projected portion 1*c*, together with the projecting wall 38*h* of the holder 38, surrounds the leading end portion of the terminal 311, that is, a contact portion between the terminal 311 and the power-fed terminal 27. Thus, the projected portion 1*c* and the projecting wall 38*h* surround the periphery of the contact portion between the terminal 311 and the power-fed terminal 27, thereby preventing foreign substance such as powder, dust, and the like, from adhering to the terminal 311 and thus ensuring stable power supply.

Preferably, the projected portion 1*c* and the projecting wall 38*h* surround the contact portion between the terminal 311 and the power-fed terminal 27 as well as contact each other loosely or closely. In the case of the former, even though there is a slight gap between them, adhesion of the foreign substance to the terminal 311 can be prevented. It should be noted that, alternatively, the shape of the projected portion 1*c* and the projecting wall 38*h* is not limited to the straight lines or right angles as illustrated in FIG. 25 but instead may be curved.

Except for the structure as described above referring to FIGS. 24 and 25, the configuration of the present embodiment is the same as the embodiment described referring to FIGS. 19 to 23 and thus redundant explanation is omitted. Although not illustrated, the structure to surround the terminal 311 by the projected portion 1*c* and the projecting wall 38*h* may be applied to such a case in which the holder 38 is not movable, contrary to the construction of FIG. 10.

Figure 26:
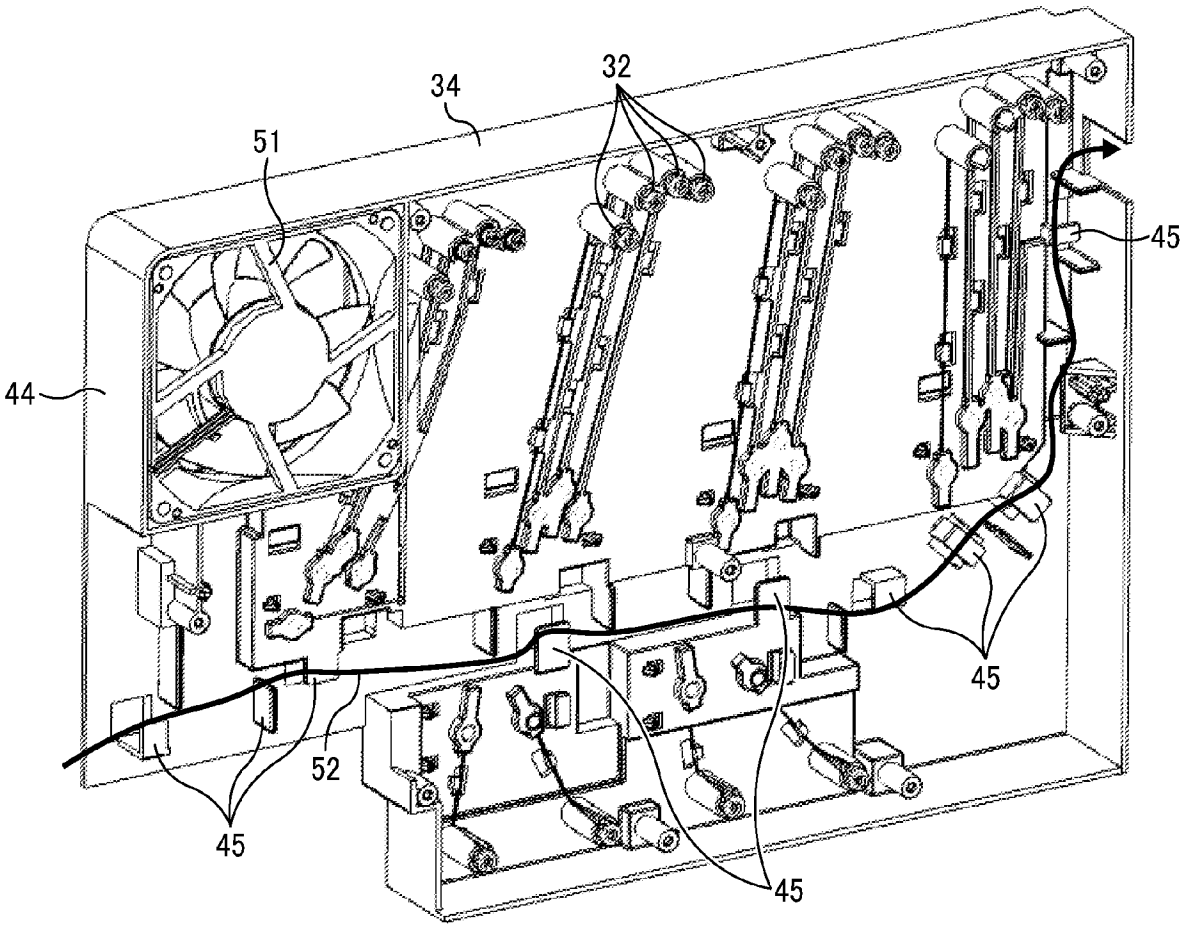
FIG. 26 shows a configuration in which a support member supports a fan and a harness.

FIG. 26 shows an embodiment in which the support member 34 holds a fan and a harness.

In the present embodiment, a fan retainer 44 to hold a fan 51 and harness retainers 45 to hold a harness 52 are disposed on the outside surface of the support member 34. The harness 52 feeds electricity to electronic parts other than the processing unit. Because the support member 34 is configured to hold the fan 51 and the harness 52, dedicated members to hold the fan 51 and the harness 52 can be omitted, thereby saving a space and reducing a manufacturing cost.

As described above, in this embodiment, the connector 33 is disposed to pass through the support member 34, so that the unit contact portion 31 and the board contact portion 32, held on opposite surfaces of the connector 33, can be connected without mounting the connector 33 between frames. Thus, assembly is facilitated and rendered efficient.

In addition, in the present embodiment, the portion that electrically conductively contacts the processing unit and the power supply board is divided into two contact portions, the unit contact portion 31 and the board contact portion 32, which prevents transmission of variations in load due to the attachment/detachment of the processing unit to the power supply board. As a result, damage to the power supply board can be restricted. In addition, because the contact portion is divided into two parts, assembly is facilitated. Further, because each position of the contact portions, that is, the unit contact portion 31 and the board contact portion 32 can be independently set, freer layout design becomes possible.

Further, in the present embodiment, because the biasing force of the unit contact portion 31 comes from the support member 34, positional shift of the unit contact portion 31 due to attachment/detachment of the processing unit is minimized and the biasing force becomes stable.

In the above embodiments, a case in which electricity is fed from the power supply device to the processing unit has been described, but the present invention is not limited to the aforementioned embodiments. The structure described in the present invention can be applied to the following devices including: a developing device to supply a developer to a latent image carried on a latent image carrier to develop it; a transfer unit to transfer the developed image on the latent image carrier to a recording medium or an intermediate transfer member; or another transfer unit to transfer the developed image transferred on the intermediate transfer member to a recording medium.

In addition, a method to form an image to which the present invention is applied is not limited to the above electrophotographic method. Alternatively, the present invention can be applied to an apparatus employing any other image forming method such as an inkjet method. The present invention may also be applied to, not limited to a printer, a copier, a facsimile machine, or a multi-function apparatus having one or more capabilities of the above devices.

Additional modifications and variations of the present invention are possible in light of the above teachings. It is therefore to be understood that, within the scope of the appended claims, the invention may be practiced other than as specifically described herein.

What is claimed is:

1. A power supply device to electroconductively connect a power-fed terminal included in a power-fed unit and a power supply terminal of a power supply board, comprising:

a unit contact portion to contact the power-fed terminal;

a board contact portion to contact the power supply board;

a connector to connect the unit contact portion and the board contact portion; and a support member to support the unit contact portion, the board contact portion, and the connector, wherein the unit contact portion is held on an inner face of the support member opposed to the power-fed unit, the board contact portion is held on an outer face of the support member opposed to the power supply board, and the connector connects the unit contact portion and the board contact portion through the support member, and wherein the board contact portion is formed of a first biasing member to elastically press against the power supply board, and the unit contact portion is formed of a second biasing member to elastically press against the power-fed unit.

2. The power supply device as claimed in claim 1, wherein the connector is formed as a single integrated unit with the board contact portion or the unit contact portion.

3. The power supply device as claimed in claim 1, wherein each of the unit contact portion and the board contact portion is a coil spring.

4. The power supply device as claimed in claim 3, wherein the support member further comprises a cylindrical holder to hold the board contact portion formed of the coil spring, and the board contact portion comprises an end turn having one end protruding from the cylindrical holder and the other end inserted into the holder with no compression of the coil spring.

5. The power supply device as claimed in claim 3, wherein an end of the board contact portion formed of the coil spring is wound in the form of a pigtail.

6. The power supply device as claimed in claim 3, wherein an end of the unit contact portion formed of the coil spring is formed of a metal terminal contactable with the power-fed unit.

7. The power supply device as claimed in claim 1, wherein the connector includes a plurality of connectors and the plurality of connectors intersect.

8. The power supply device as claimed in claim 7, further comprising a separator, disposed in the support member at a portion where the connectors intersect each other, to prevent the connectors from contacting each other.

9. The power supply device as claimed in claim 1, wherein the power-fed unit is a developing device configured to supply a developer to a latent image on a latent image carrier to develop the latent image into a visible image.

10. The power supply device as claimed in claim 1, wherein the power-fed unit is a transfer device to transfer a developed image on a latent image carrier to a recording medium or an intermediate transfer body.

11. The power supply device as claimed in claim 1, wherein the power-fed unit is a transfer device to transfer a developed image which has been transferred to an intermediate transfer body onto a recording medium.

12. The power supply device as claimed in claim 1, wherein the support member comprises a fan holder to hold a fan.

13. The power supply device as claimed in claim 1, further comprising:

a holder to contact the power-fed unit, disposed movably in a direction approaching or separating from a unit attachment area in which the power-fed unit is attached;

a biasing member that presses against the holder toward the unit attachment area;

a terminal to contact the power-fed unit, the terminal movable in the direction approaching or separating from the unit attachment area independently from the holder; and a biasing member that presses against the terminal toward the unit attachment area, wherein the terminal to contact the power-fed unit and the biasing member that presses against the terminal are held by the holder, wherein the biasing force of the biasing member that presses against the holder is greater than that of the biasing member that presses against the terminal.

14. The power supply device as claimed in claim 13, further comprising a projecting wall disposed on the holder facing the power-fed unit and contactable with the power-fed unit.

15. A power-fed unit comprising a power-fed portion electroconductively connected with a power feeding portion included in a power supply board via the power supply device as claimed in claim 14, the power-fed unit further comprising:

a projected portion, disposed on a face facing the holder, that, in association with the projecting wall, surrounds the contact portion between the terminal and the power-fed terminal.

16. An image forming apparatus comprising a power supply device as claimed in claim 15.

17. A power supply device to electroconductively connect a power-fed terminal included in a power-fed unit and a power supply terminal of a power supply board, comprising:

a unit contact portion to contact the power-fed terminal;

a board contact portion to contact the power supply board;

a connector to connect the unit contact portion and the board contact portion;

a support member to support the unit contact portion, the board contact portion, and the connector; and a plurality of unit contact portions, a plurality of board contact portions, and a plurality of connectors, wherein the unit contact portion is held on an inner face of the support member opposed to the power-fed unit, the board contact portion is held on an outer face of the support member opposed to the power supply board, and the connector connects the unit contact portion and the board contact portion through the support member, and wherein each support member comprises guides that separate the connectors from each other and arranges them in parallel, and each guide is formed either straight or curved.

18. A power supply device to electroconductively connect a power-fed terminal included in a power-fed unit and a power supply terminal of a power supply board, comprising:

a unit contact portion to contact the power-fed terminal;

a board contact portion to contact the power supply board;

a connector to connect the unit contact portion and the board contact portion; and a support member to support the unit contact portion, the board contact portion, and the connector, wherein the unit contact portion is held on an inner face of the support member opposed to the power-fed unit, the board contact portion is held on an outer face of the support member opposed to the power supply board, and the connector connects the unit contact portion and the board contact portion through the support member, wherein the support member comprises a harness holder to hold a harness to supply power to electronic parts other than the power-fed unit.

* * * * *